US005129158A

United States Patent [19]

Campagna

[11] Patent Number: 5,129,158

[45] Date of Patent: Jul. 14, 1992

[54] PLASTIC PIPE CUTTER

[75] Inventor: John A. Campagna, Jefferson, Ohio

[73] Assignee: Rex International USA, Ashtabula, Ohio

[21] Appl. No.: 632,972

[22] Filed: Dec. 24, 1990

[51] Int. Cl.[5] ..... B26B 13/00; B26B 27/00

[52] U.S. Cl. ..... 30/92; 30/243

[58] Field of Search ..... 30/92, 241-243; 81/135, 136, 14 D; 74/84 R, 120

[56] References Cited

U.S. PATENT DOCUMENTS

| | | | |
|---|---|---|---|
| 1,352,009 | 9/1920 | Lillquist | 81/136 |
| 2,644,194 | 7/1953 | Fill | 30/92 X |
| 4,608,754 | 9/1986 | Kloster | 30/92 |
| 4,627,167 | 12/1986 | Karubian et al. | 30/241 X |
| 5,018,275 | 5/1991 | Huang | 30/92 X |

*Primary Examiner*—Douglas D. Watts

*Attorney, Agent, or Firm*—Woodling, Krost & Rust

[57] ABSTRACT

The invention is a cutter for plastic pipe which utilizes a guillotine cutting action in combination with a blade having a straight edge forming a converging angle to the cutting anvil of the cutter.

38 Claims, 3 Drawing Sheets

PLASTIC PIPE CUTTER

FIELD OF THE INVENTION

This invention relates to a plastic pipe cutter with a guillotine design.

Historically, cutters for plastic pipe including ABS, PVC, rubber and neoprene hose, have been pivoting cutters. U.S. Pat. No. 4,176,450 (Cutter Mainly for Cutting Synthetic Resin Articles) and U.S. Pat. No. 4,674,184 (Cutting Tool For Synthetic Resin Tubes) are typical cutters. In these cutters a blade is pivotally mounted to a frame to cut a plastic pipe against an anvil having a three sided cavity. The cavity shaped anvil acts as a reaction surface in addition to securing the plastic pipe in position against the outward forces caused by the pivoting motion of the cutting blade. The cutters themselves utilize a various ratchet mechanism in order to compensate for the differing angular efficiencies of the cutters at various points in the cutting arc. Two hands are customarily needed in order to open the cutters in preparation for cutting. Due to the pivoting action of the cutter, there are certain limitations to how near the edge of a pipe the cutter can cut. Also the mechanical efficiencies of pivoting cutters necessitate care in utilizing these cutters. These combine to limit the suitability of the cutters for various applications.

OBJECTS OF THE INVENTION

It is an object of this invention to simplify cutters.

It is an object of this invention to allow one hand operation of cutters.

It is an object of this invention to provide for a guillotine cut in a cutter.

It is an object of this invention to provide for improved cutting control.

It is an object of this invention to facilitate cutting operations for plastic pipe.

It is an object of this invention to allow for smaller pieces of plastic pipe to be cut in a single operation.

It is an object of this invention to allow for straighter cuts in a cutting operation. Other objects and a more complete understanding of the invention may be had by referring to the following description and drawings in which:

DESCRIPTION OF THE PREFERRED EMBODIMENT

Figure 1:
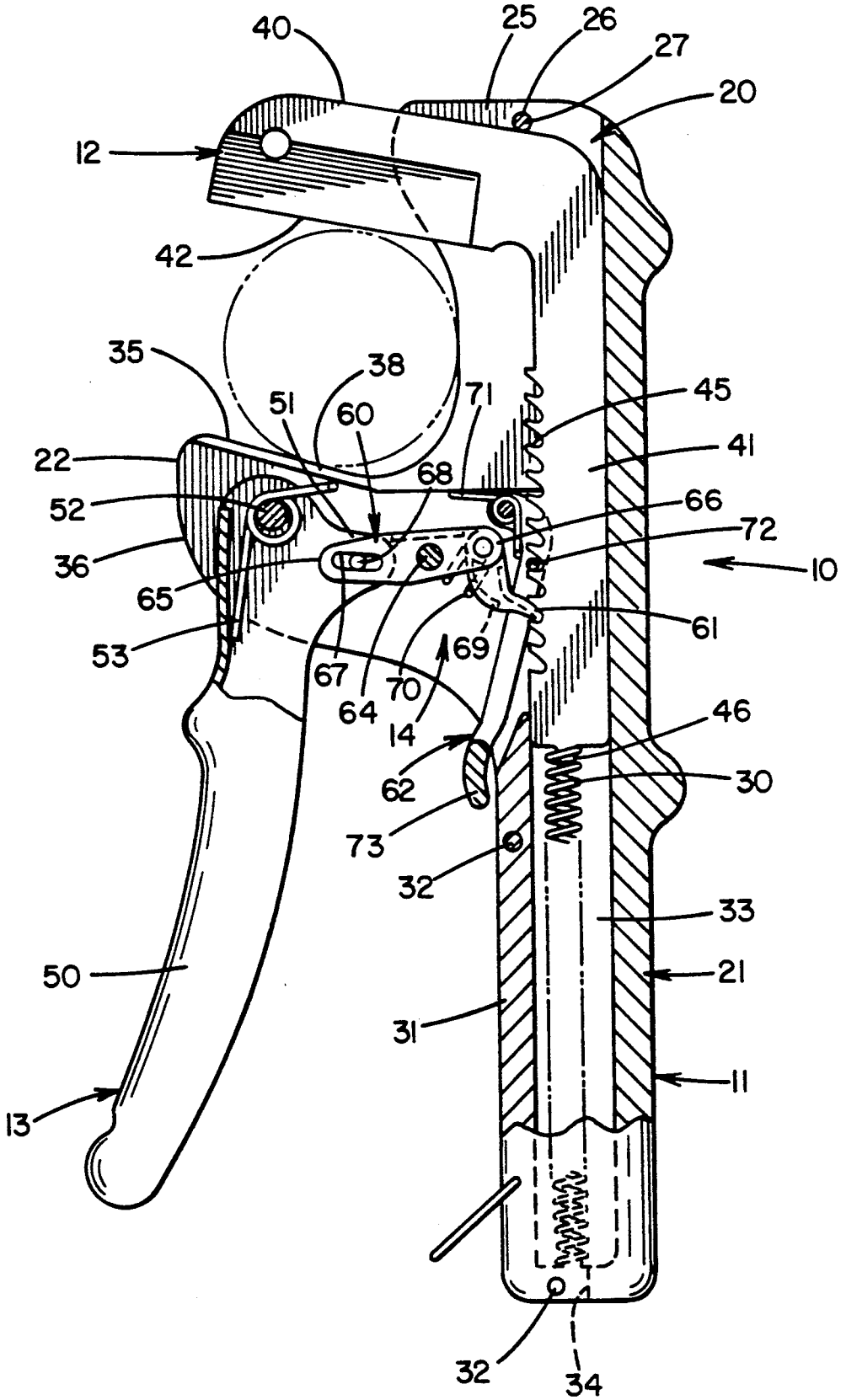
FIG. 1 is a longitudinal cross sectional planar view of a cutter including the invention of the application. The cutter is shown in an open condition.
Figure 3:
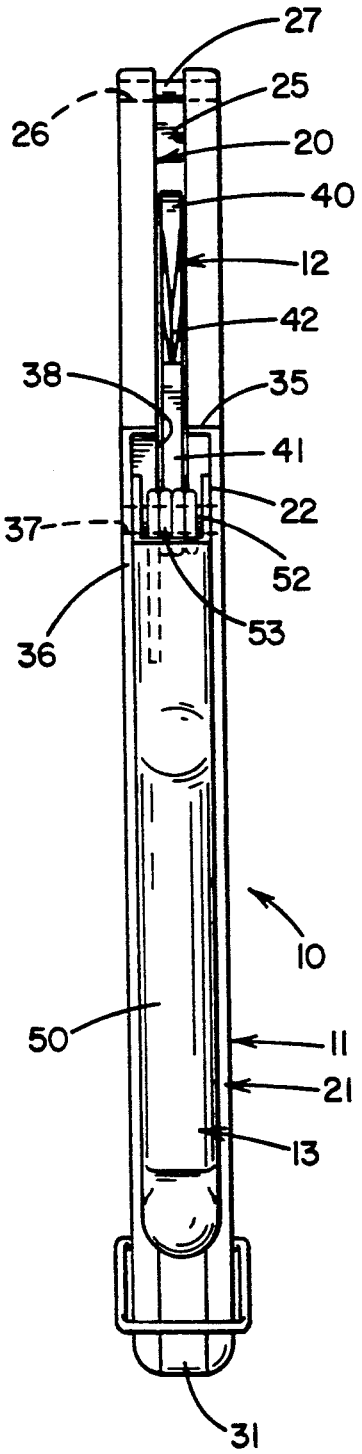
FIG. 3 is a view of the cutter of FIG. 2 taken generally from the left side thereof.
Figure 2:
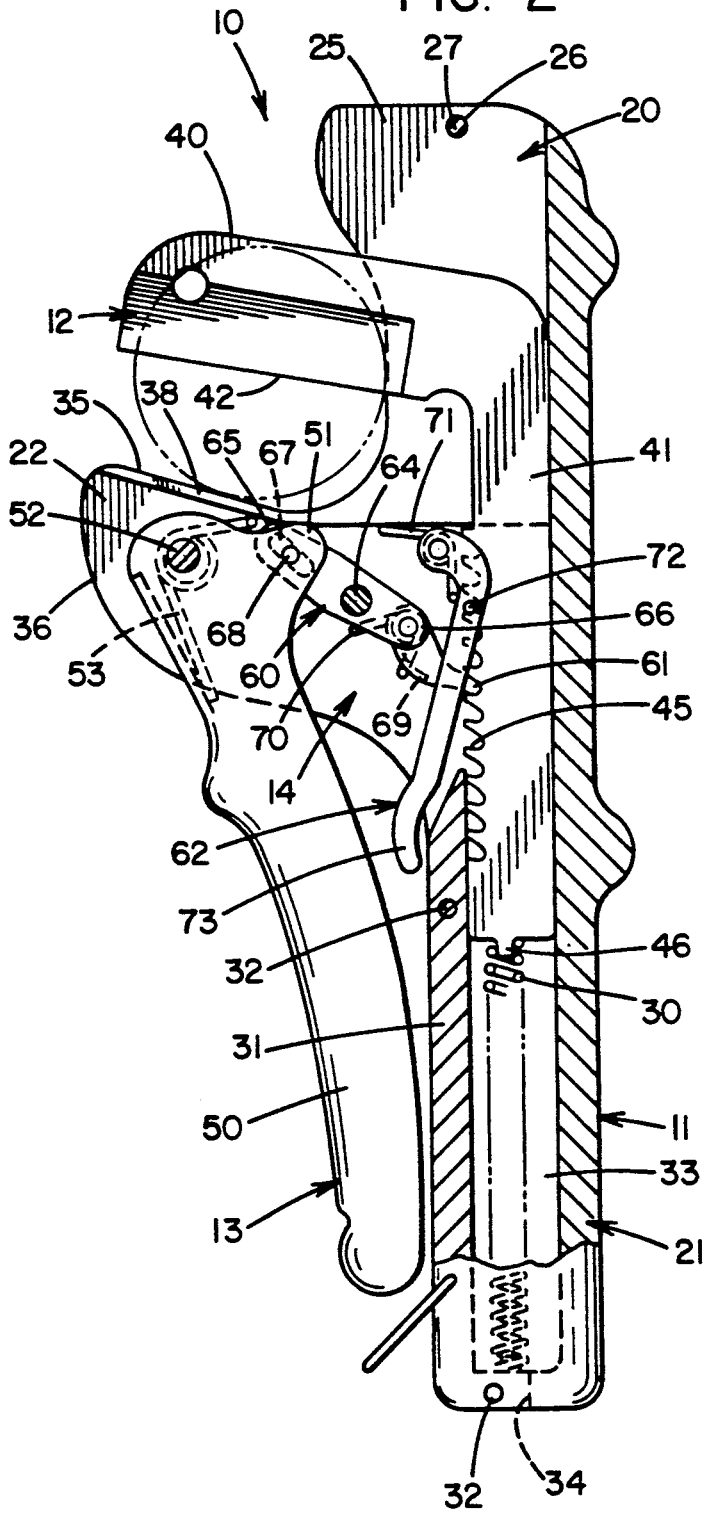
FIG. 2 is a longitudinal cross sectional planar view like FIG. 1 showing the cutter in a partially closed position.
Figure 4:
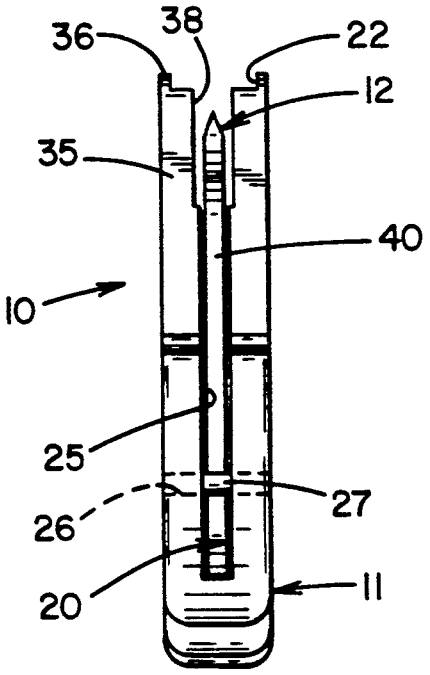
FIG. 4 is a view of the cutter end of the cutter of FIG. 2 taken generally from the top thereof.
Figure 5:
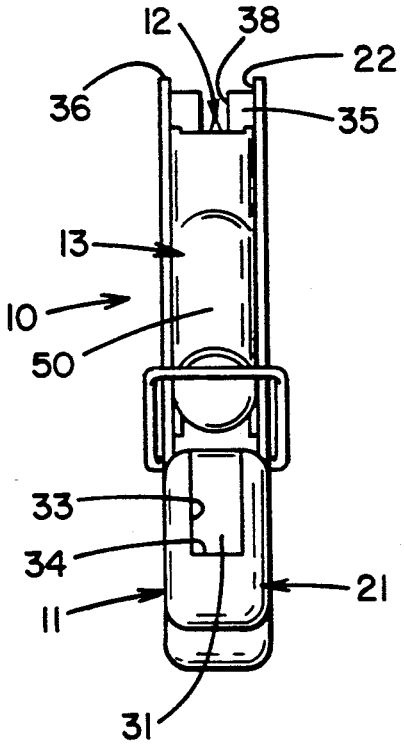
FIG. 5 is a view of the handle end of the cutter of FIG. 2 taken generally from the bottom thereof.
Figure 6:
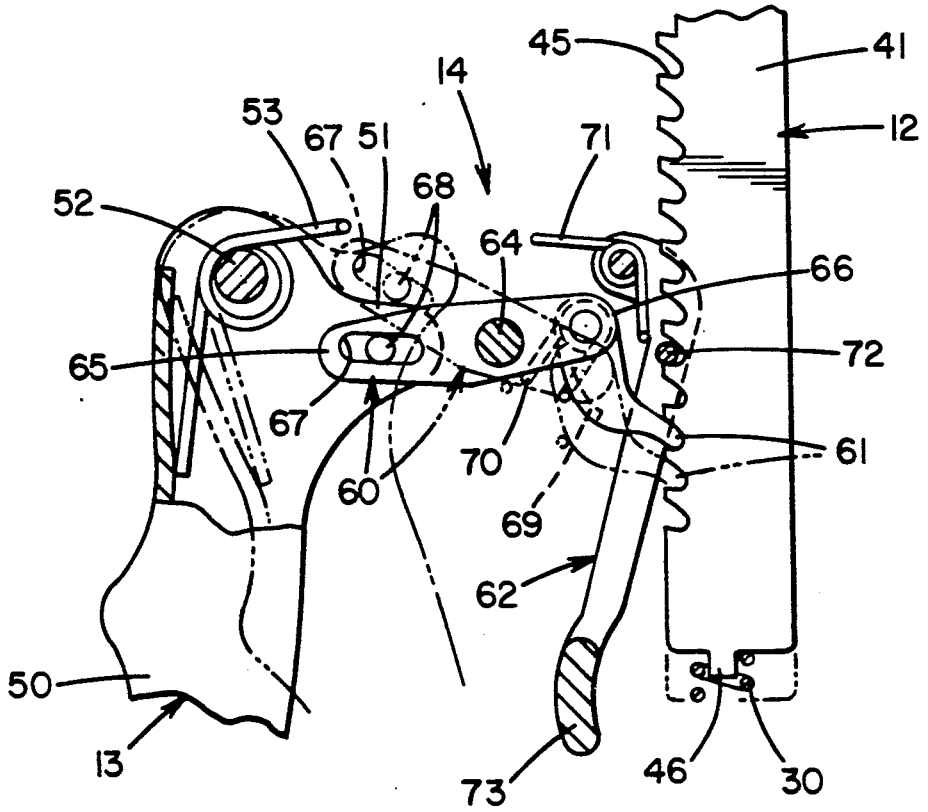
FIG. 6 is a view of the operating mechanism of the cutter of FIG. 1.

This invention relates to a cutter with a guillotine operation. The invention will be described in its preferred embodiment of a cutter for plastic pipe. By plastic pipe, it is meant ABS, PBC, polyethylene, polybutylene, polypropylene, DMV, rubber, neoprene, vinyl tubing, air conditioning hose, welding hose, and other such tubing.

The cutter 10 has a body 11, a blade 12, a handle 13, and an operating mechanism 14.

The body 11 for the cutter mechanically interconnects the other parts of the cutter. In the preferred embodiment disclosed, the body 11 also provides one of the grips for the cutter. The preferred body 11 is a metal die casting having an alignment section 20, a spring section 21, and an anvil section 22.

The alignment section 20 of the body 11 serves to guide the blade 12 (later described) as well as insuring the correct alignment thereof. To accomplish this, the preferred alignment section 20 has a groove 25 extending longitudinally therein. In the particular embodiment disclosed, this groove 25 opens through the protruding end of the alignment section 20 so as to allow the longitudinal insertion of the blade 12 from the end of the body 11 of the cutter 10. The groove 25 itself has a width which is just slightly more than the width of the blade 12. This dimensional relationship allows the blade 12 to slide in such groove 25 longitudinally of the body 11 while at the same time retaining such blade against side to side wobbling to remain in a constant angular relationship with such body 11. A hole 26 is provided in the end of the alignment section 20. After the unit is assembled, a pin 27 is inserted into this hole 26 in order to insure that the blade 12 remains in operative position in respect to the body 11 of the cutter 10. Upon removal of this pin 27, it is possible in the preferred embodiment to insert/remove the blade 12 from the body 11 of the cutter 10 for manufacture/repair/replacement of such blade 12.

The spring section 21 of the body 11 of the cutter 10 serves two purposes. The first purpose of this section 21 is to provide a location for the spring 30 which biases the cutting edge 42 of the blade 12 away from the later described anvil section 22. To accomplish this, the section 21 is formed in a "U" shaped cross sectional channel 33 having a significant opening extending upwards therefrom. This is preferred because it allows the end stop 34 of the body 11 to be integral with such body 11. The spring 30, preferably made of stainless steel, is then dropped into this channel 33 with a cast spring retainer 31 closing the opening of the channel 33. The length of the spring 30 is chosen such that the blade 12 is biased against the spring 27 in the end of the alignment section 20 when such blade 12 is unrestrainedly free to move (as is later described). As the tension of this spring 30 must be overcome in the operation of the device, it is preferred that excess tension not be provided. Two small pins 32 interconnect the spring retainer 31 to the section 21 so as to prevent the separation thereof. The section 21 thus provides for an internal spring 30 while at the same time allowing for the easy manufacture of the body 11. It is preferred the channel 33 open in the same direction as the groove 25. This allows a single piece die to be utilized for both the groove and channel.

The second purpose of the spring section 21 is (in the preferred embodiment) to provide one handle for the cutter 10. This handle is provided by the external surface 22 of the body 11 about the spring 30. This dual usage contributes to the compactness of the cutter 10 by combining functions (i.e., spring location and handle in the same physical area).

The anvil section 22 of the body 11 of the cutter 10 serves again two purposes. The first purpose of the anvil section 22 is to provide a reaction edge 35 for the cutting edge of the blade 12. In use, the reaction edge 35 cooperates with the cutting edge 42 of the blade 12 to accomplish the cutting action. It is preferred that the reaction edge 35 have a converging relationship with the cutting edge 42 of the blade 12. By this it is meant that the distance between the reaction edge 35 and the cutting edge 42 of the blade 12 is greater along the alignment section 20 than between the end 36 of the anvil section 22 and the free end of the blade 12. This angular relationship insures that the pipe which is being cut will be securely held in position and also that soft and hard to cut pipe will be cut cleanly. In this respect it is important to note that a minimal deviation off of parallel between these two surfaces will hold the pipe in position throughout the entire cutting operation. As such the extensive cavity which is necessary in a pivoting cutting tools is not necessary. Note that in the preferred embodiment disclosed, the groove 25 in the alignment section 20 has a corresponding aligned groove 38 in the reaction edge 35 of the anvil section 22. This groove 38 allows for an over travel of the cutting edge 42 of the blade 12 in respect to the reaction edge 35 of the anvil section 22. This insures the cutting operation will be complete upon operation of the cutter 10. This groove 38 also facilitates the construction of the device by allowing for an efficient die cast operation in that a single plug is necessary for the entire body 11.

In addition to providing a reaction edge 35, the anvil section 22 also serves to pivotally mount the handle 13 to the body 11 of the cutter 10. To accomplish this, the anvil section 22 is provided with a pivot hole 37 near the end 36 of such anvil section 22 (mounting of handle later described). Again this dual usage contributes to the compactness of the cutter 10.

The blade 12 is the main operative member for the cutter 10. This blade 12 includes a cutting section 40 and a ratchet section 41. The cutting section 40 serves to support and strengthen the cutting edge 42 of the blade 12. In addition the cutting section 40 and ratchet section 41 interact with the groove 25 in the alignment section 20 of the body 11 of the cutter 10 in order to prevent the angular wobbling of the cutting blade 12 in respect to the body 11 of the cutter 10. This blade 12 thus synergistically acts with the body 11 to cause an efficient cutting operation. It is preferred the blade 12 be provided with a rounded outer protruding end so as to eliminate its digging in should the cutter 10 be dropped.

The ratchet section 41 of the blade 12 cooperates with the handle 13 of the cutter 10 through the operating mechanism 14 in order to operatively move the blade 12 through its operative cycle. In the preferred embodiment shown, this ratchet section 41 is a section extending off of the cutting section 40 so as to form a unitary "L" shaped member. This is preferred in that the length of the ratchet section 41 acts as a lever arm in cooperation with the retainer 31 to support the cutting section 40 against pivoting due to the forces of cutting. The teeth 45 of the preferred ratchet section 41 are generally angled towards the cutting edge 42 of the blade 12 so as to provide for an operative connection with the main movement mechanism 14 (later described). The total length of the teeth 45 along the ratchet section 41 is preferably such at one end the operating mechanism pawl 60 (later described) can engage the teeth 45 when the blade 12 is near to contact with the pin 27—i.e. all the way open—and at the other end the interlock of the release lever 62 does not engage a tooth 45 after the cutting edge 40 of the blade 12 passes the plane of the reaction edge 35 of the anvil section 22. The angle that the cutting section 40 makes with the ratchet section 41 is not critical as long as the angular relationship between the cutting edge 42 of the blade 12 and the reaction edge 35 of the anvil section 22 is maintained. In the particular embodiment disclosed, the cutting edge 42 has an angular relationship of substantially 95° in respect to the ratchet section 41 of the blade 12. There is a small nub 46 located off of the end of the ratchet section 41. This nub 46 interconnects the blade 12 with the spring 30 of the body 11 thus aligning these parts with each other. Due to the use of a nub 46 instead of a hook or an eye, the blade 12 can be easily removed from the body 11 of the cutter 10 upon removal of the pin 27 at the end of the alignment section 20 of such body 11. This again facilitates the construction of the cutter 10 and/or maintenance of the blade 12.

The handle 13 is the main consumer manipulative control of the cutter 10. The handle 13 includes an extending section 50 and a connection section 51. The handle 13 itself is interconnected to the anvil section 22 of the body 11 of the cutter by a pivot bolt 52 intermediate to the extending section 50 and connection section 51 of the handle 13 for a pivoting action in respect thereto. The extending section 50 is the main operative control for the cutter 10. In use the operator manipulates this extending section 50 within the angular arc permitted by its interconnection to the body 11 so as to operate the cutter 10. Normally this operation necessitates a number of ratchets to complete a single cut. It is preferred that the open rest position of the extending section 50 of the handle 13 be such that the intending operator can easily grip such extending section 50 while also holding the handle section 21 of the body 11 of the cutter 10. This allows an easy, single handed cutting operation. A spring 53 biases the handle 13 in an outward position.

The connection section 51 of the handle 13 interconnects with the operating mechanism 14 so as to operate the device. The connection section 51 is displaced from the pivot bolt 52 by a certain distance. This distance is chosen in combination with the leverage of the operating mechanism 14 so as to provide for a secure and controllable cutting operation. In the particular embodiment disclosed, this distance is substantially ¾".

The operating mechanism 14 is the mechanism that, in combination with the ratchet section 41 of the blade 12, converts the angular rotary motion of the handle 13 into a linear motion of the blade 12. This provides for the guillotine operation of the cutter 10. The operating mechanism 4 accomplishes this through the use of a link lever 60, a pawl 1, and a reverse/interlock member 62.

The link lever 60 serves to convert the forward motion of the connection section 51 of the handle 13 into a desired rearward movement. The link lever 60 accomplishes this by having a pivot pin 64 located between the two ends 65, 66 of the link lever. The end 65 of the link lever 60 is interconnected by a pin 68 to the connection section 51 of the handle 13. In order to compensate for the rotary motion of the handle 13, this interconnection between the link lever 60 and the connection section 51 of the handle 13 is by a slot 67 in the link lever 60. This slot 67 compensates for the fact that the distances between the pivot bolt 52 and the pivot pin 64 are fixed while the link lever 60 and the connection section 51 travel in an arc—i.e. vary over angular movement. The end 66 of the link lever is interconnected with the pawl 61 as later described. The differences between the distances between the pin 68 and the end of the pawl 61 and the pivot pin 64 respectively could provide for an additional reduction for the device if desired. In the particular embodiment disclosed, the distance between the pivot pin 64 and the end 65 is substantially equal to the distance between the pivot pin 64 and the end 66. For this reason the torque available at the end of the pawl 61 is approximately equal to that at the pin 68. This is preferred so as to equalize the forces on the link lever 60.

The pawl 61 is mounted to the end 66 of the link lever 60. This pawl 61 is spring loaded into interconnection with the teeth 45 of the ratchet section 41 of the blade 12 by a pawl spring 70. This pawl spring 70 interacts with the pivot pin 64 and the body 11 of the pawl 61 in order to spring load the pawl 61 into contact with the teeth 45 of the blade 12. Due to this interconnection, any forward motion of the end 65 of the link lever 60 is transferred into a rearward motion of the ratchet section 41 of the blade 12 through the pawl 61. This provides for the guillotine cutting action of the cutter 10.

The operating mechanism 14 also provides for a sure cutting action without the need for a tension adjustment to keep the blade 12 from bouncing back on soft pipe. The release/interlock member 62 extends between the body 11 of the cutter 10 and the ratchet section 41 of the blade 12. The member 62 is included in the cutter 10 for two purposes. The primary purpose of the member 62 is to provide for a reaction member for the operating mechanism 14. This reaction member is provided by spring loading the interlock pin 68 of the member 62 into contact with the teeth of the ratchet section 41. This is accomplished by use of the interlock spring 71. This interlock spring 71 interacts between the body 11 of the cutter 0 and the member 62 in order to bias the member 62 into contact with the teeth 45 of the ratchet section 41. Due to this interconnection, any movement of the ratchet section 41 beyond one tooth's distance will cause the member 62 to engage a differing tooth 45 than previously engaged. Due to this reoccurring engagement, the release or counter rotation of the link lever 61 will cause the ratchet section 41 to remain in substantially the position moved by the pawl 61 while the pawl 1 is allowed to move a tooth or two further up the ratchet section 41. This interconnection means that for the selective movement of the handle 13, the blade 12 will move towards the anvil section 22 of the body 11 of the cutter 10. In the preferred embodiment disclosed, this movement is one tooth for each manipulation of the handle 13.

The second use of the member 62 is to allow for the return of the blade 12 to its original full open position. This is accomplished by pulling the release handle 73 of the member 62 away from the handle section 21. This movement separates the interlock pin 68 and pawl 61 from the teeth 45 of the ratchet section. (The end of the pawl 61 is disengaged via an intermediate shoulder 69 extending off of the pawl 61 next to the member 62. Without physical movement of the release handle 73, the shoulder 69 is preferably not in contact with the member 62.) As these are the only things holding the blade 12 in its inward position, this enables the spring 30 to push the blade 13 outward of the body 11 of the cutter 10 to again contact the pin 27 at the end of the alignment section 20 of the body 11 of the cutter 10. The cutter 10 is then returned to its initial open operative position. Upon release of the member 62, the interlock pin 68 and pawl 61 reengage the teeth 45 of the ratchet section. The release member 62 shown is designed to be manipulated by the same hand holding the cutter 10. This allows for a single handed cutting operation through release. This is to be contrasted with the typical pivoting cutter wherein two hands are needed in order to manually reset the pivoting cutting blade back to an initial open position.

Although the operating mechanism 14 shown is preferred for its strength and simplicity, other mechanisms can be substituted for transforming a hand movement into a longitudinal guillotine cutting action of the cutting blade 12 if desired. These alternate mechanisms include gears, levers, wires, bands and other such mechanisms.

To operate the device, an individual holds the body 11 of the cutter 10 in his/her palm with his/her thumb lightly surrounding the spring/handle section 21 and his/her fingers around the extending section 50 of the handle. The cutting section 40 of the blade 12 is in a fully extended position. At this time the individual tightens his/her fingers around the extending section 50 of the handle 13 and brings such section 50 together with the handle section 21 of the body. This moves the ratchet section 41 (and thus the cutting section 40) of the blade 12 one tooth inward into the handle section 21 of the body 11. At this time the release lever 62 moves outwardly and inwardly against the pressure of the interlock spring 71 to engage the interlock pin 68 into the next tooth 45 in the ratchet section 41. Upon the individuals release of the extending section 50 of the handle 13, the pawl 61 moves against the pawl spring 70 into an engagement with the next tooth on the ratchet section 41. The individual then repeats this action as many times as necessary in order to cut the pipe between the cutting edge 42 of the blade 12 and the reaction edge 35 of the anvil section 22. Due to the location of the teeth 45 on the ratchet section 41, it is impossible for the operator to move the blade 12 into damaging engagement with the anvil section 22 or the operating mechanism 14 contained therein. Note that if a pipe having a small diameter is going to be cut, the above operation can be facilitated slightly by manually pushing the cutting section 40 of the blade 12 into the anvil section 22 of the body 11 of the cutter until the cutting edge 42 is in engagement with such pipe.

Upon completion of the cutting operation, the individual wraps two fingers (normally around the handle section 21 of the body 11 either a fore finger/middle finger and thumb) to push the release lever 62 outwardly of the handle section 21 of the body 11. This action disengages the pawl 61 and interlock pin 68 from the ratchet section 41. This in turn allows the spring 30 to push the blade 12 outwardly of the anvil section 22 into engagement with the pin 27. This returns the cutter 10 to its initial opened starting position for another cutting operation.

Although the invention has been described in its preferred form with a certain degree of particularity, it is to be understood that numerous changes can be made without deviating from the invention as hereinafter claimed.

What is claimed:

1. In a cutter for plastic materials, said cutter including a body and a cutting blade, said cutting blade having a straight cutting edge having a first end operatively connected to said body and a free second end, said body having a straight reaction edge with a first end and a free second end, said cutting edge of said cutting blade forming a converging angle in respect to said reaction edge with a first distance between said first end of said cutting edge and said first end of said reaction edge being greater than a second distance between said first end of said cutting blade and said second end of said reaction edge, and operation means to move said cutting edge towards said reaction edge at a constant angle to form a guillotine cutter.

2. The cutter of claim 1 characterized in that said cutting blade includes a ratchet section, said cutting edge having an end, said ratchet section extending off said end of said cutting edge, and said operation means including said ratchet section.

3. The cutter of claim 1 characterized in that said operation means includes a handle and said handle being pivotally connected to said body.

4. The cutter of claim 1 characterized in that said body includes an alignment section, said alignment section holding said cutting edge in a constant angular position in respect to said body and guiding said cutting edge in movement towards said reaction edge.

5. The cutter of claim 4 characterized by said alignment section having an end, said end having a groove, and said groove allowing access to said cutting blade.

6. In a cutter for plastic materials, said cutter including a cutting blade, said cutting blade having a cutting edge, a body, said body having a reaction edge, said cutting edge of said cutting blade forming a converging angle in respect to said reaction edge and operation means to move said cutting edge towards said reaction edge at a constant angle to form a guillotine cutter, said body including an alignment section holding said cutting edge in a constant angular position in respect to said body and guiding said cutting edge in a constant angular position in respect to said body and guiding said cutting edge in movement towards said reaction edge, said alignment section having an end, said end having a groove, and said groove allowing access to said cutting blade, and a pin and said pin blocking said groove so as to retain said cutting blade in said alignment section.

7. The cutter of claim 2 characterized by the addition of a spring, said spring extending between said ratchet section and said body to bias said cutting edge away from said reaction edge.

8. In a cutter for plastic materials, said cutter including a cutting blade, said cutting blade having a cutting edge, a body, said body having a reaction edge, said cutting edge of said cutting blade forming a converging angle in respect to said reaction edge and operation means to move said cutting edge towards said reaction edge at a constant angle to form a guillotine cutting said cutting blade including a ratchet section, said cutting edge having an end, said ratchet section extending off said end of said cutting edge, said operation means including said ratchet section, the addition of a spring, said spring extending between said ratchet section and said body to bias said cutting edge away from said reaction edge, and said body having a handle section and said spring being in said handle section.

9. In a cutter for plastic materials, said cutter including a cutting blade, said cutting blade having a cutting edge, a body, said body having a reaction edge, said cutting edge of said cutting blade forming a converging angle in respect to said reaction edge and operation means to move said cutting edge towards said reaction edge at a constant angle to form a guillotine cutter, said operation means including a handle and said handle being pivotally connected to said body, said operation means including a ratchet section, said ratchet section including teeth, a link lever, said link lever having two ends, means to rotatively connect said link lever to said body between said two ends, means to connect one end of said link lever to said handle, a pawl, and said pawl being connected to said other end of said link lever extending between said link lever and said teeth of said ratchet section.

10. The cutter of claim 9 characterized in that said operation means includes a release lever, said release lever extending between said body and said teeth of said ratchet section, a spring, and said spring biasing said release lever into contact with said teeth.

11. In a cutter for plastic materials, said cutter including a cutting blade, said cutting blade having a straight cutting edge and a ratchet section, said cutting edge having a first end and a free second end with said cutting edge extending therebetween, said ratchet section extending off said first end of said cutting edge, a body, said body having a straight reaction edge with a first end and a free second end, said cutting edge of said cutting blade forming a converging angle in respect to said reaction edge and operation means including said ratchet section to move said cutting edge towards said reaction edge at a constant angle to form a guillotine cutter.

12. The cutter of claim 11 characterized in that said body includes an alignment section, said alignment section holding said cutting edge in a constant angular position in respect to said body and guiding said cutting edge in movement towards said reaction edge.

13. The cutter of claim 12 characterized by said alignment section having an end, said end having a groove, and said groove allowing access to said cutting blade.

14. In a cutter for plastic materials, said cutter including a cutting blade, said cutting blade having a straight cutting edge and a ratchet section, said cutting edge having an end therebetween, said ratchet section extending off said end of said cutting edge, a body, said body having a straight reaction edge, said cutting edge of said cutting blade forming a converging angle in respect to said reaction edge and operation means including said ratchet section to move said cutting edge towards said reaction edge at a constant angle to form a guillotine cutter, said body including an alignment section, said alignment section holding said cutting edge in a constant angular position in respect to said body and guiding said cutting edge in movement towards said reaction edge, said alignment section having an end, said end having a groove, said groove allowing access to said cutting blade, and a pin and said pin blocking said groove so as to retain said cutting blade in said alignment section.

15. The cutter of claim 1 characterized by the addition of a spring, said spring extending between said ratchet section and said body to bias said cutting edge away from said reaction edge.

16. In a cutter for plastic materials, said cutter including a cutting blade, said cutting blade having a cutting edge, a body, said body having a reaction edge, said cutting edge of said cutting blade forming a converging angle in respect to said reaction edge and operation means to move said cutting edge towards said reaction edge at a constant angle to form a guillotine cutter, a spring, said spring extending between said ratchet section and said body to bias said cutting edge away from said reaction edge, said body having a handle section and said spring being in said handle section.

17. In a cutter for plastic materials, said cutter including a cutting blade, said cutting blade having a straight cutting edge and a ratchet section, said cutting edge having an end therebetween, said ratchet section extending off said end of said cutting edge, a body, said body having a straight reaction edge, said cutting edge of said cutting blade forming a converging angle in respect to said reaction edge and operation means including said ratchet section to move said cutting edge towards said reaction edge at a constant angle to form a guillotine cutter, said ratchet section including teeth, a handle, said handle being pivotally connected to said body, a link lever, said link lever having two ends, said link lever being rotatively mounted to said body between said two ends, means to connect one end of said link lever to said handle, a pawl, and said pawl being connected to said other end of said link lever extending between said link lever and said teeth of said ratchet section.

18. The cutter of claim 17 characterized in that said operation means includes a release lever, said release lever extending between said body and said teeth of said ratchet section, a spring, and said spring biasing said release lever into contact with said teeth.

19. A cutter for plastic materials, said cutter having a body having a reaction edge and an alignment section and a handle section, said alignment section having a groove, said reaction edge being straight and having a first end and a free second end, a handle, said handle being pivotally mounted to said body, a cutting blade, said cutting blade having a straight cutting edge and a ratchet section, said cutting edge having a first end and a free second end with said cutting edge extending therebetween, said ratchet section extending off said first end of said cutting edge, said cutting blade being in said groove in said alignment section, said cutting edge of said cutting blade forming a converging angle in respect to said reaction edge, and operation means including said handle and said ratchet section to move said cutting edge towards said reaction edge at a constant angle to form a guillotine cutter.

20. The cutter of claim 19, characterized in that said alignment section has an end, and said groove extending through said end of said alignment section to allow access to said cutting blade.

21. A cutter for plastic materials, said cutter having a body having a reaction edge and an alignment section and a handle section, said alignment section having a groove, said reaction edge being straight, a handle, said handle being pivotally mounted to said body, a cutting blade, said cutting blade having a straight cutting edge and a ratchet section, said cutting edge having an end, said ratchet section extending off said end of said cutting edge, said cutting blade being in said groove in said alignment section, said cutting edge of said cutting blade forming a converging angle in respect to said reaction edge, and operation means including said handle and said ratchet section to move said cutting edge towards said reaction edge at a constant angle to form a guillotine cutter, said alignment section having an end, and said groove extending through said end of said alignment section to allow access to said cutting blade, a pin, and said pin blocking said groove at said end of said alignment section so as to retain said cutting blade in said alignment section.

22. The cutter of claim 19 characterized by the addition of a spring, and said spring extending between said ratchet section and said body to bias said cutting edge away from said reaction edge.

23. A cutter for plastic materials, said cutter having a body, said body having a reaction edge and an alignment section and a handle section, said alignment section having a groove, said reaction edge being straight, a handle, said handle being pivotally mounted to said body, a cutting blade, said cutting blade having a straight cutting edge and a ratchet section, said cutting edge having an end, said ratchet section extending off said end of said cutting edge, said cutting blade being in said groove in said alignment section, said cutting edge of said cutting blade forming a converging angle in respect to said reaction edge, and operation means including said handle and said ratchet section to move said cutting edge towards said reaction edge at a constant angle to form a guillotine cutter, a spring, and said spring extending between said ratchet section and said body to bias said cutting edge away from said reaction edge, said spring being in said handle section of said cutter.

24. A cutter for plastic materials, said cutter having a body, said body having a reaction edge and an alignment section and a handle section, said alignment section having a groove, said reaction edge being straight, a handle, said handle being pivotally mounted to said body, a cutting blade, said cutting blade having a straight cutting edge and a ratchet section, said cutting edge having an end, said ratchet section extending off said end of said cutting edge, said cutting blade being in said groove in said alignment section, said cutting edge of said cutting blade forming a converging angle in respect to said reaction edge, and operation means including said handle and said ratchet section to move said cutting edge towards said reaction edge at a constant angle to form a guillotine cutter, said operation means includes said ratchet section including teeth, a link lever, said link lever having two ends, means to connect one end of said link lever to said handle, a pawl, and said pawl being connected to said other end of said link lever extending between said link lever and said teeth of said ratchet section.

25. The cutter of claim 24 characterized in that said operation means includes a release lever, said release lever extending between said body and said teeth of said ratchet section, a spring, and said spring biasing said release lever into contact with said teeth.

26. A cutter for plastic materials, said cutter having a body, said body having an alignment section and a handle and a reaction edge, said alignment section having an axis, said reaction edge extending generally perpendicular to said axis of said alignment section and having a first end and a free second end, a groove, said groove being in said alignment section along said axis thereof, a cutting blade, said cutting blade having a straight cutting edge and a ratchet section, said cutting edge having a first end and a free second end with said cutting edge extending therebetween, said ratchet section extending off said first end of said cutting edge, said cutting blade being located in said groove in said alignment section with said ratchet section directed towards said handle said cutting edge of said cutting blade forming a converging angle in respect to said reaction edge of said body, a second handle, said second handle being pivotally mounted to said body, and operation means including said second handle and said ratchet section of said cutting blade to move said cutting edge of said cutting blade towards said reaction edge of said body at a constant angle to form a guillotine cutter.

27. The cutter of claim 26 characterized in that said groove has an open end to allow access to said cutting blade.

28. A cutter for plastic materials, said cutter comprising a body, said body having an alignment section and a handle and a reaction edge, said alignment section having an axis, said reaction edge extending generally perpendicular to said axis of said alignment section, a groove, said groove being in said alignment section along said axis thereof, a cutting blade, said cutting blade having a straight cutting edge and a ratchet section, said cutting edge having an end with said cutting edge extending therebetween, said ratchet section extending off said end of said cutting edge, said cutting blade being located in said groove in said alignment section with said ratchet section directed towards said handle, said cutting edge of said cutting blade forming a converging angle in respect to said reaction edge of said body, a second handle, said second handle being pivotally mounted to said body, and operation means including said second handle and said ratchet section of said cutting blade to move said cutting edge of said cutting blade towards said reaction edge of said body at a constant angle to form a guillotine cutter, said spring is in said handle section of said cutter, said groove has an open end to allow access to said cutting blade, a pin and said pin blocking said groove so as to retain said cutting blade in said alignment section.

29. The cutter of claim 26 characterized by the addition of a spring, said spring extending between said ratchet section and said body to bias said cutting edge away from said reaction edge.

30. A cutter for plastic materials, said cutter comprising a body, said body having an alignment section and a handle and a reaction edge, said alignment section having an axis, said reaction edge extending generally perpendicular to said axis of said alignment section, a groove, said groove being in said alignment section along said axis thereof, a cutting blade, said cutting blade having a straight cutting edge and a ratchet section, said cutting edge having an end with said cutting edge extending therebetween, said ratchet section extending off said end of said cutting edge, said cutting blade being located in said groove in said alignment section with said ratchet section directed towards said handle, said cutting edge of said cutting blade forming a converging angle in respect to said reaction edge of said body, a second handle, said second handle being pivotally mounted to said body, and operation means including said second handle and said ratchet section of said cutting blade to move said cutting edge of said cutting blade towards said reaction edge of said body at a constant angle to form a guillotine cutter, said operation means includes a link lever, said link lever having two ends, means to connect one end of said link lever to said second handle, a pawl, and said pawl being connected to said other end of said link lever extending between said link lever and said teeth of said ratchet section.

31. The cutter of claim 30 characterized in that said operation means includes a release lever, said release lever extending between said body and said teeth of said ratchet section, a spring, and said spring biasing said release lever into contact with said teeth.

32. A cutter for plastic materials, said cutter comprising a body having an alignment section with an axis, a groove, said groove being in said alignment section extending along said axis thereof, a cutting blade, said cutting blade having a straight cutting edge with a first end connected to said body and a free second end with said cutting edge extending therebetween, said body having a straight reaction edge with a first end and a free second end, an aligned groove in the reaction edge to receive the cutting edge of the cutting blade, said cutting blade being in said groove with said alignment section aligning same and operation means to move said cutting blade along the axis of the alignment section and into said aligned groove to provide a guillotine cutting action.

33. A cutter, said cutter comprising a body, a handle pivotally attached to said body, a cutting blade and an operating mechanism for transforming pivoting motion of said handle into linear motion of said cutting blade, said mechanism comprising a ratchet section, said ratchet section being part of said cutting blade, said ratchet section including teeth, a link lever, said link lever having two ends, said link lever being rotatively mounted to said body between said two ends, means to connect one end of said link lever to the handle, a pawl, and said pawl being connected to said other end of said link lever and said teeth of said ratchet section.

34. The cutter of claim 33 characterized in that said operating mechanism includes a release lever, said release lever extending between said body and said teeth of said ratchet section, a spring, and said spring biasing said release lever into contact with said teeth.

35. In a cutter having a body and a linear moving cutting blade, an improved release mechanism comprising the cutting blade having a ratchet section, said ratchet section having teeth, a release lever extending between the body and said teeth of said ratchet section, a spring, said spring biasing said release lever into contact with said teeth, and said release lever being separable from said teeth and an operating mechanism including a pawl engaged with said teeth of said ratchet section and said pawl being separable from said teeth via said release lever.

36. The cutter of claim 11 characterized by a first distance between said first end of said cutting blade and the first end of said reaction edge being greater than a second distance between said second end of said cutting blade and the second end of said reaction edge.

37. The cutter of claim 19 characterized by a first distance between said first end of said cutting blade and the first end of said reaction edge being greater than a second distance between said second end of said cutting blade and the second end of said reaction edge.

38. The cutter of claim 26 characterized by a first distance between said first end of said cutting blade and the first end of said reaction edge being greater than a second distance between said second end of said cutting blade and the second end of said reaction edge.

* * * * *